US006169473B1

(12) United States Patent
Asano

(10) Patent No.: US 6,169,473 B1
(45) Date of Patent: Jan. 2, 2001

(54) SCREW-DRIVEN MULTITURN ELECTRICAL DEVICE

(75) Inventor: Masahiro Asano, Miyagi-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/574,932

(22) Filed: May 19, 2000

(30) Foreign Application Priority Data

May 20, 1999 (JP) ..... 11-140721

(51) Int. Cl.[7] ..... H01C 10/42
(52) U.S. Cl. ..... 338/180; 338/DIG. 1
(58) Field of Search ..... 338/180, 181, 338/DIG. 1, 176

(56) References Cited

U.S. PATENT DOCUMENTS

| | | | |
|---|---|---|---|
| 2,862,089 | 11/1958 | Mairs | 338/180 |
| 3,634,805 | 1/1972 | Jestrzemski et al. | 338/180 |
| 3,670,286 | 6/1972 | Bang et al. | 338/180 |
| 3,694,788 * | 9/1972 | Perrisini . | |
| 3,938,070 * | 2/1976 | Koerner et al. . | |
| 6,078,249 | 6/2000 | Slavik et al. | 338/180 |

* cited by examiner

*Primary Examiner*—Karl D. Easthom
(74) *Attorney, Agent, or Firm*—Brinks Hofer Gilson & Lione

(57) ABSTRACT

An internally threaded carrying member is engaged with a screw thread formed on an operating shaft and is in frictional engagement with a moving member. A first projection is formed at one end part of the operating shaft and a second projection is formed on the internally threaded carrying member so as to correspond to the first projection. Upon the arrival of the internally threaded carrying member at one end of its stroke on the operating shaft together with the moving member as the operating shaft is rotated in one direction, the first projection and the second projection are engaged. Then, the internally threaded carrying member is rotated together with the operating shaft against a frictional resistance exerted thereon by the moving member as the operating shaft is rotated further in the same direction.

2 Claims, 4 Drawing Sheets

SCREW-DRIVEN MULTITURN ELECTRICAL DEVICE

BACKGROUND OF THE INVENTION

1. Field of the Invention

The present invention relates to a screw-driven multiturn electrical device, such as a variable resistor.

2. Description of the Related Art

A variable resistor as an example of a known screw-driven multiturn electrical device will be described with reference to FIGS. 4 to 7. As shown in FIG. 4, a wiper contact holding member 53 having the shape of a rectangular prism and holding a wiper contact 52 on its lower surface is supported on a drive shaft 54 in a resistor case 51.

Referring to FIGS. 5 and 6, the wiper contact holding member 53 is combined with the drive shaft 54 by extending the drive shaft 54 in a groove 53*a* formed in a central part of the upper surface of the wiping contact holding member 53 and retaining the wiper contact holding member 53 on the drive shaft 54 by a U-shaped spring 55 having a pair of leg parts 55*a* and a crossing part 55*b* extending between the leg parts 55*a*. The spring 55 is put on the wiper contact holding member 53 with the leg parts 55*a* thereof extended obliquely across the groove 53*a*, the crossing part 55*b* thereof engaged with a projection 53*b* formed in one of the side walls of the groove 53*a*, and extreme end parts 55*c* of the leg parts 55*a* received in small grooves 53*c* formed in the other side wall of the groove 53*a*.

As shown in FIG. 7, the leg parts 55*a* of the spring 55 are in engagement with a screw thread formed in the circumference of the drive shaft 54, and the extreme end parts 55*c* are in elastic contact with the upper wall of the resistor case 51.

In this known variable resistor thus composed, the drive shaft 54 is rotated to drive the wiper contact holding member 53 through the spring 55 for longitudinal movement to vary an output signal by moving the wiper contact 52 (FIG. 4). Since the extreme end parts 55*c* of the spring 55 are in contact with the upper wall of the resistor case 51 so as to apply a moderate pressure to the upper wall, so that the wiper contact holding member 53 is restrained from rattling. When the drive shaft 54 continues to rotate after the wiper contact holding member 53 has reached either of the opposite ends of it stroke, the leg parts 55*a* of the spring 55 are disengaged from the screw thread of the drive shaft 54, so that any excessive force is exerted on the wiper contact holding member 53.

In this known variable resistor, however, the disengagement of the leg parts 55*a* of the spring 55 from the screw thread of the drive shaft 54 is repeated when the drive shaft 54 continues to rotate after the wiper contact holding member 53 has reached either of the opposite ends of its stroke. Consequently, the leg parts 55*a* of the spring 55 are rubbed by the screw thread of the drive shaft 54 and noise is generated.

Since the leg parts 55*a* of the spring 55 are disengaged from the screw thread of the drive shaft 54 when the drive shaft 54 continues to rotate after the wiper contact holding member 53 has reached either of the opposite ends of it stroke, the wiper contact holding member 53 does not start moving immediately even if the rotation of the drive shaft 54 is reversed, until the leg parts 55*a* of the spring 55 are engaged with the screw thread of the drive shaft 54. The variable resistor having such a lost motion cannot be used for some purposes.

SUMMARY OF THE INVENTION

Accordingly, it is an object of the present invention to provide a screw-driven multiturn electrical device not generating noise and capable of being applied to all kinds of purposes.

According to one aspect of the present invention, a screw-driven multiturn electrical device comprises: an operating shaft provided with a screw thread in its circumference and having at least one end part provided with a first projection; an internally threaded carrying member in engagement with the screw thread of the operating shaft and provided with a second projection that is brought into engagement with the first projection serving as a stopper at the end of the operating shaft; and a moving member in frictional engagement with the internally threaded carrying member; wherein the moving member moves together with the internally threaded carrying member toward the end of the operating shaft when the operating shaft is rotated in one direction to change the level of electric signal, the internally threaded carrying member is turned together with the operating shaft against a frictional resistance exerted thereon by the moving member after the second projection of the internally threaded carrying member has been brought into engagement with the first projection of the operating shaft, and the second projection is separated from the first projection and the moving member moves axially together with the internally threaded carrying member toward an axially middle part when the rotation of the operating shaft rotating together with the internally threaded carrying member is reversed.

This screw-driven multiturn electrical device does not generate any noise because the internally threaded carrying member turns together with the operating shaft against the frictional resistance exerted thereon by the moving member. Since the first and the second projection are separated from each other and the moving member moves axially toward an axially middle part when the rotation of the operating shaft is reversed, the screw-driven multiturn electrical device can be applied to all kinds of purposes.

In the screw-driven multiturn electrical device according to the present invention, it is preferable that the moving member has an external shape resembling that of a structure formed by combining semicylindrical parts and a flat part, the flat part is provided with an opening through which the internally threaded carrying member is received, the semicylindrical parts are arranged so as to define a groove for receiving a part of the internally threaded carrying member therein for the frictional engagement of the moving member and the internally threaded carrying member. The internally threaded carrying member and the moving member of this screw-driven multiturn electrical device can be easily assembled.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
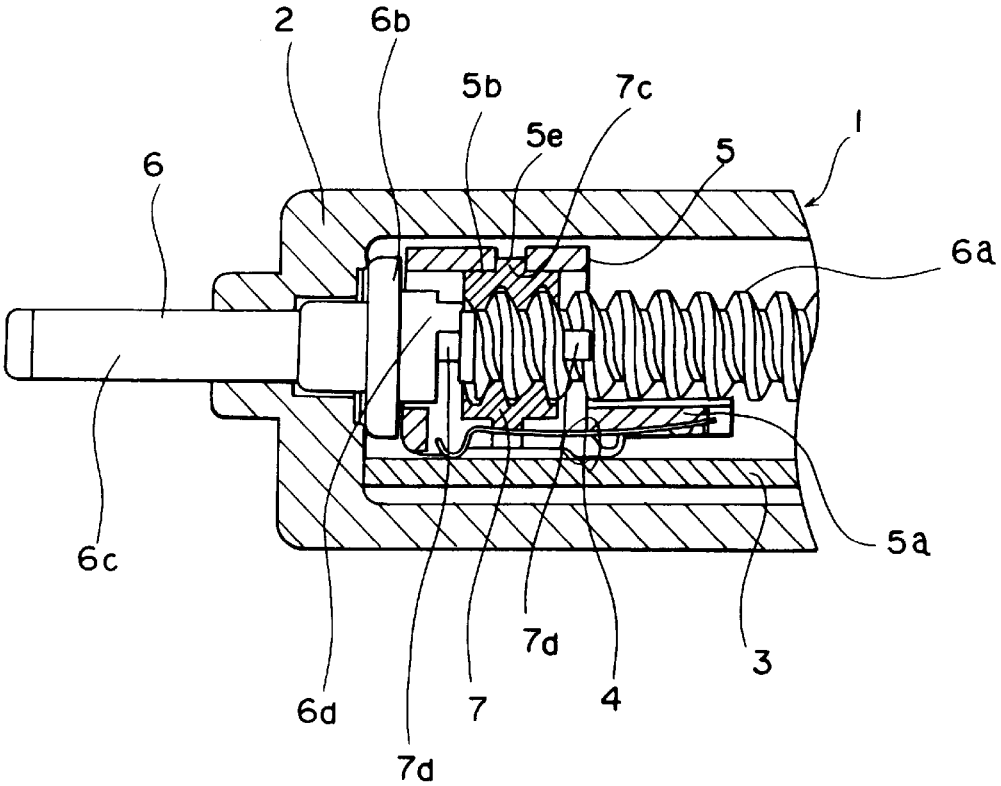
FIG. 1 is a fragmentary longitudinal sectional view of a variable resistor, i.e., a screw-driven multiturn electrical device, in a preferred embodiment according to the present invention.

Referring to FIG. 1, a variable resistor 1 in a preferred embodiment according to the present invention includes a case 2, an insulating substrate 3 fixedly held in the case 2 and provided with a resistor pattern, not shown, a moving member 5 provided with a wiper contact 4 in sliding contact with the resistor pattern of the insulating substrate 3, an internally threaded carrying member 7 made of a synthetic resin, such as polyacetal, provided with an internal screw thread and frictionally engaged with the moving member 5, and an operating shaft 6 formed of a metal, such as brass, provided with an external screw thread 6*a* and extended through the internally threaded carrying member 7.

Figure 3:
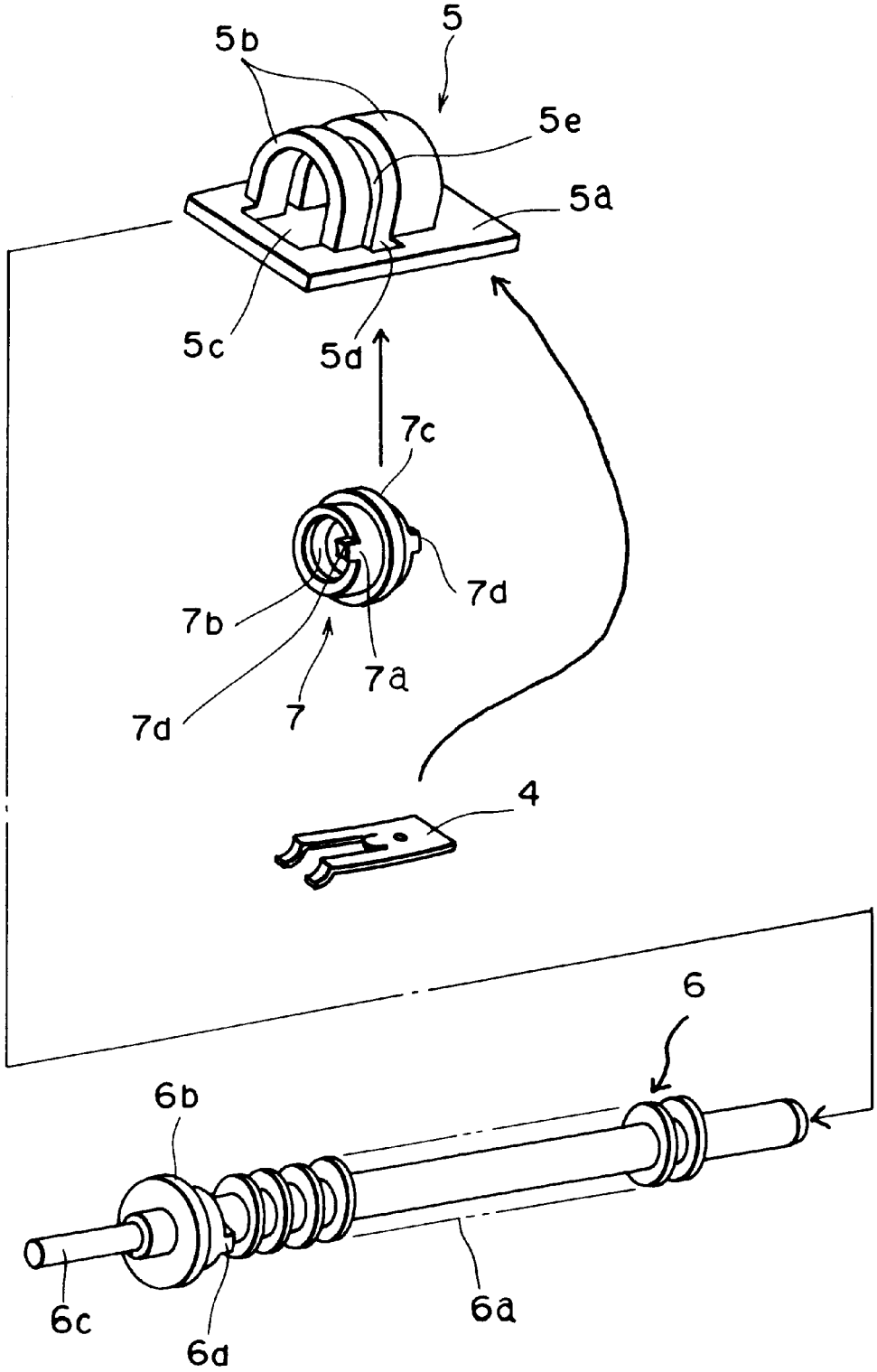
FIG. 3 is an exploded perspective view of the variable resistor shown in FIG. 1.
Figure 4:
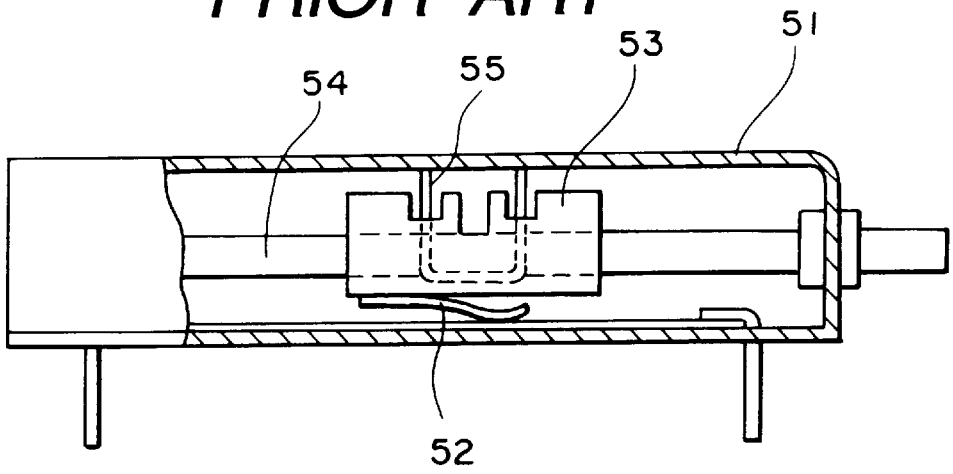
FIG. 4 PRIOR ART
FIG. 4 is a partly cutaway front elevation of a conventional variable resistor.
Figure 5:
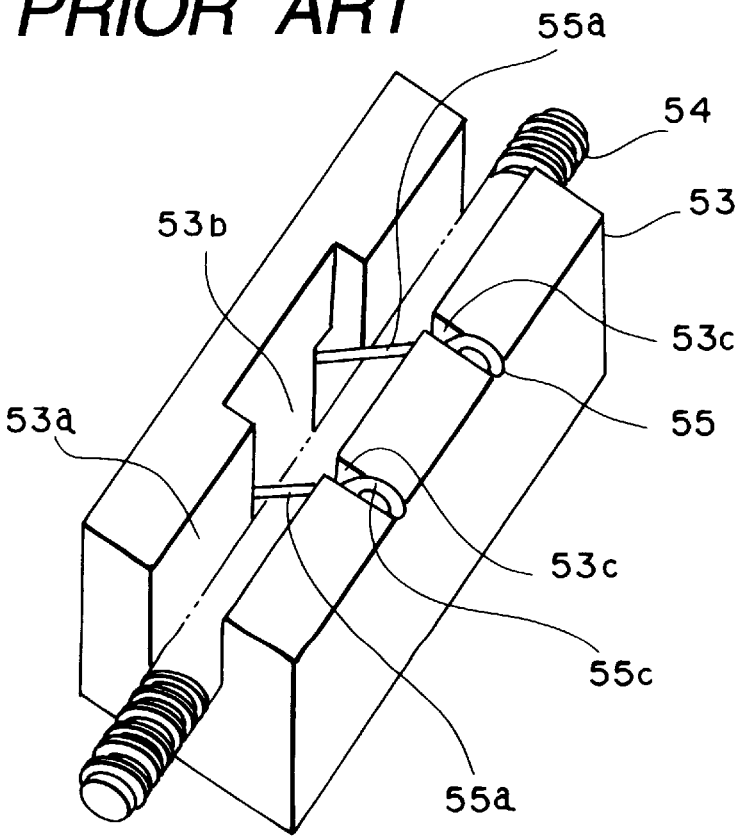
FIG. 5 PRIOR ART
FIG. 5 is a perspective view of a wiper contact holding member included in the variable resistor shown in FIG. 4.
Figure 6:
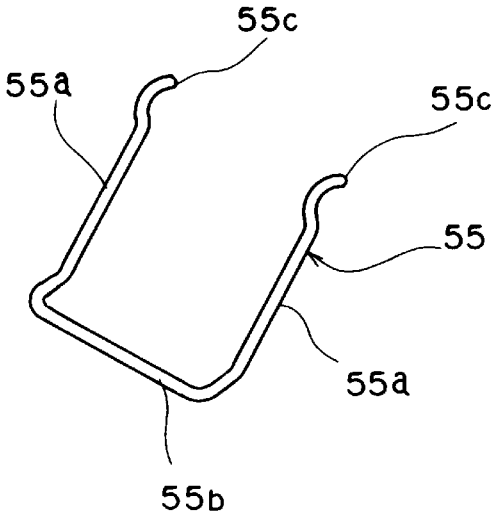
FIG. 6 PRIOR ART
FIG. 6 is a perspective view of a spring attached to the wiper contact holding member shown in FIG. 5.
Figure 7:
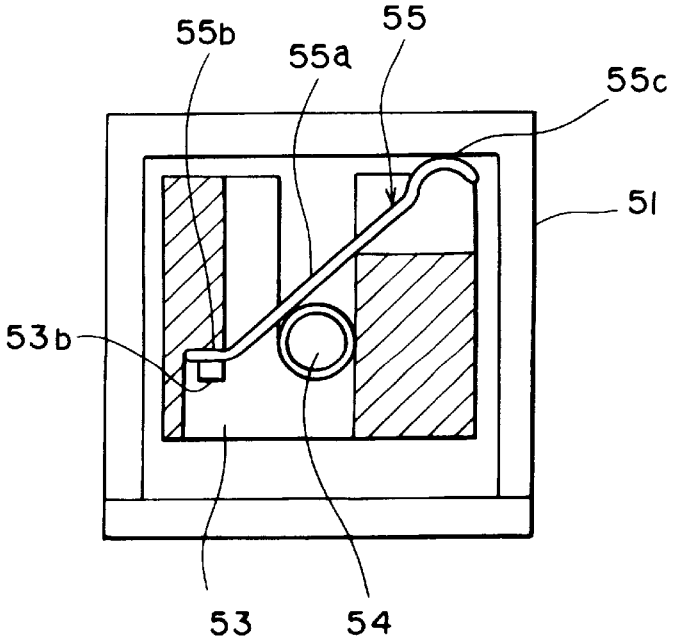
FIG. 7 is a sectional view of the variable resistor shown in FIG. 4.

As shown in FIG. 3, the operating shaft 6 has one end part provided with a circular flange 6*b* and a control projection 6*c* projecting outside from the case 2. A rectangular first projection 6*d* projects from the flange 6*b* of the operating shaft 6 toward a middle part of the external screw thread 6*a*. The internally threaded carrying member 7 has a main part 7*a* provided with an internal screw thread 7*b* that engages the external screw thread 6*a* of the operating shaft 6, two second projections 7*d* projecting from the opposite ends thereof axially away from each other, and an annular projection 7*c* formed on the circumference of a middle part of the main part 7*a*.

The moving member 5 has a flat part 5*a* and a semicylindrical parts 5*b* as shown in FIG. 3. The flat part 5*a* is provided with a rectangular opening 5*c* having a laterally expanded middle section 5*d*. The semicylindrical parts 5*b* are formed integrally with the flat part 5*a* so as to cover the rectangular opening 5*c*. The semicylindrical parts 5*b* are spaced apart so as to define a groove 5*e* corresponding to the laterally expanded section 5*d*.

The internally threaded carrying member 7 is put in a space defined by the semicylindrical parts 5*b* through the rectangular opening 5*c* of the moving member 5 so that the annular projection 7*c* is fitted in the groove 5*e* between the semicylindrical parts 5*b*. Thus the moving member 5 and the internally threaded carrying member 7 are engaged frictionally.

Figure 2:
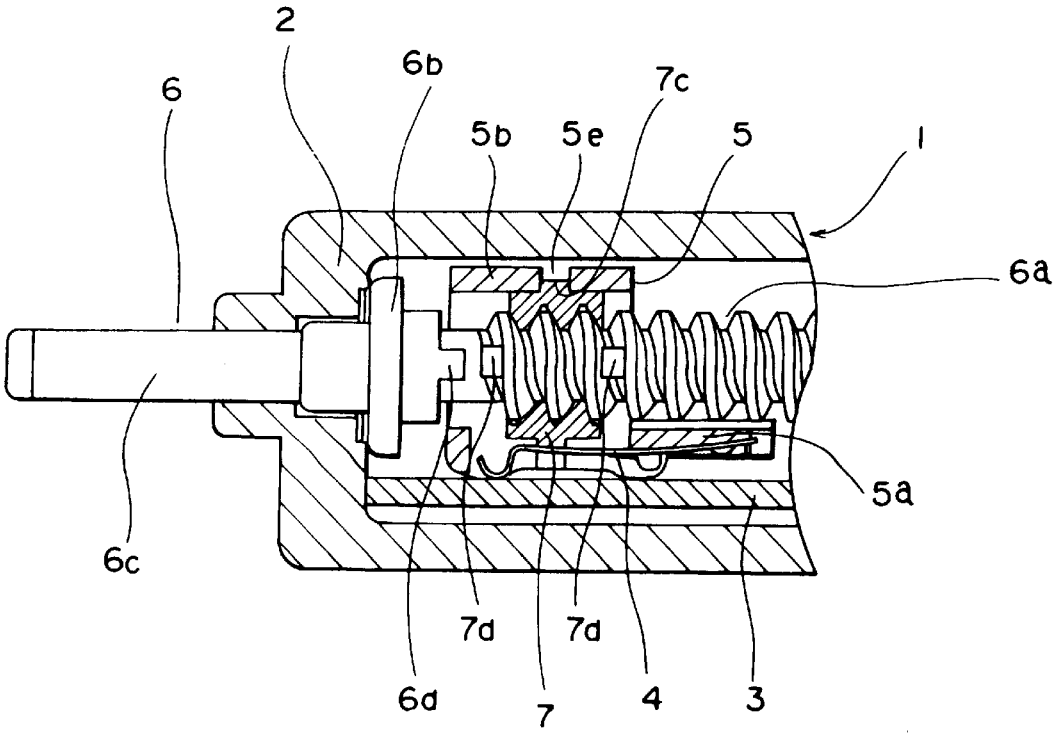
FIG. 2 is a view similar to FIG. 1 and showing the variable resistor in a state different from that of the same shown in FIG. 1.

After assembling the moving member 5 and the internally threaded carrying member 7, a wiper contact 4 of a metal is attached to the lower surface of the flat part 5*a* of the moving member 5. Then, an assembly of the operating shaft 6, the moving member 5, the internally threaded carrying member 7 and the wiper contact 4 is disposed in the case 2 to complete the variable resistor 1 as shown in FIGS. 1 and 2.

When the control projection 6*c* of the operating shaft 6 of the variable resistor 1 is rotated, the internally threaded carrying member 7 engaged with the screw thread 6*a* of the operating shaft 6 and frictionally engaged with the moving member 5 moves axially along the operating shaft 6 together with the moving member 5 in the case 2. The wiper contact 4 is thus moved so as to slide along the resistor pattern to vary the output signal of the variable resistor 1.

When the internally threaded carrying member 7 arrived at a position corresponding to an end of the screw thread 6*a* of the operating shaft 6 as shown in FIG. 1, the second projection 7*d* hits the first projection 6*d*. When the operating shaft 6 is turned further in the same direction, the first projection 6*d* in engagement with the second projection 7*d* forces the internally threaded carrying member 7 to move together with the operating shaft 6 against a frictional resistance exerted thereon by the moving member 5. When the operating shaft 6 rotating together with the internally threaded carrying member 7 is reversed, the second projection 7*d* separates immediately from the first projection 6*d* and the internally threaded carrying member 7 starts moving in the opposite direction together with the moving member 5 in the case 2.

Although the first projection 6*d* and the second projection 7*d* are projected axially in this embodiment, either the first projection 6*d* or the second projection 7*d* may be radially projected. Although the invention has been described as applied to the variable resistor provided with a resistor pattern, the present invention is applicable also to magnetic variable resistors and encoders.

As is apparent from the foregoing description, the screw-driven multiturn electrical device according to the present invention brings the second projection of the internally threaded carrying member into engagement with the first projection of the operating shaft to rotate the internally threaded carrying member together with the operating shaft after the internally threaded carrying member has reached a position corresponding to an end of the screw thread formed on the operating shaft. Therefore, any noise is not generated. When the rotation of the operating shaft is reversed, the second projection separates immediately from the first projection and the internally threaded carrying member starts moving together with the moving member along the axis of the operating shaft in the opposite direction. Thus, there is not any restrictions on the application of the screw-driven multiturn electrical device.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A screw-driven multiturn electrical device comprising:

an operating shaft provided with a screw thread in its circumference and having at least one end part provided with a first projection;

an internally threaded carrying member in engagement with the screw thread of the operating shaft and provided with a second projection that is brought into engagement with the first projection serving as a stopper at the end of the operating shaft; and a moving member in frictional engagement with the internally threaded carrying member;

wherein the moving member moves together with the internally threaded carrying member toward the end of the operating shaft when the operating shaft is rotated in one direction to change the level of electric signal, the internally threaded carrying member is turned together with the operating shaft against a frictional resistance exerted thereon by the moving member after the second projection of the internally threaded carrying member has been brought into engagement with the first projection of the operating shaft, and the second projection is separated from the first projection and the moving member moves axially together with the internally threaded carrying member toward an axially middle part when the rotation of the operating shaft rotating together with the internally threaded carrying member is reversed.

2. The screw-driven multiturn electrical device according to claim 1, wherein the moving member has an external shape resembling that of a structure formed by combining semicylindrical parts and a flat part, the flat part is provided with an opening through which the internally threaded carrying member is received, the semicylindrical parts are arranged so as to define a groove for receiving a part of the internally threaded carrying member therein for the frictional engagement of the moving member and the internally threaded carrying member.

* * * * *